United States Patent [19]

Kim

[11] Patent Number: 4,681,508

[45] Date of Patent: Jul. 21, 1987

[54] SUPERCAVITATION CENTRIFUGAL PUMP

[76] Inventor: Choong W. Kim, 756-173, Bupyong-dong, Buk-ku, Inchon, Rep. of Korea

[21] Appl. No.: 935,593

[22] Filed: Nov. 28, 1986

Related U.S. Application Data

[63] Continuation of Ser. No. 671,303, Nov. 14, 1984, abandoned.

[51] Int. Cl.[4] ..... F04D 7/04; F04D 29/22

[52] U.S. Cl. ..... 415/116; 415/213 R; 415/219 C

[58] Field of Search ..... 415/213 R, 213 A, 212 R, 415/215, DIG. 1, 116, 219 C; 416/185, 188, 179

[56] References Cited

U.S. PATENT DOCUMENTS

| | | | |
|---|---|---|---|
| 730,589 | 6/1903 | Weiss | 415/213 R X |
| 1,182,439 | 5/1916 | Wood | 415/213 R |
| 2,115,134 | 4/1938 | Andersen | 415/206 |
| 2,236,706 | 4/1941 | Damonte | 415/213 R |
| 2,272,469 | 2/1942 | Lannert | 415/213 R |
| 2,312,422 | 3/1943 | Kumlin et al. | 415/219 C |
| 2,396,083 | 3/1946 | Chase | 415/206 |
| 2,700,344 | 1/1955 | Schellens | 415/213 R X |
| 3,796,509 | 3/1974 | Wood | 415/116 |
| 4,087,994 | 5/1978 | Goodlaxson | 415/213 R X |

FOREIGN PATENT DOCUMENTS

| | | | |
|---|---|---|---|
| 2012439 | 1/1971 | Fed. Rep. of Germany | 415/213 R |
| 2307714 | 8/1973 | Fed. Rep. of Germany | 416/188 |
| 465668 | 9/1951 | Italy | 415/219 C |
| 1277416 | 6/1972 | United Kingdom | 415/213 R |

OTHER PUBLICATIONS

Pearsall, I. S.; The Supercavitating Pump; Proceedings of the Institution of Mechanical Engineers; vol. 187, No. 54, pp. 649–665; 1973.

*Primary Examiner*—Leonard E. Smith

*Attorney, Agent, or Firm*—Birch, Stewart, Kolasch & Birch

[57] ABSTRACT

A supercavitation centrifugal pump comprising an impeller casing defining an impeller chamber, a discharge port and a suction port operatively connected to the impeller casing, a water inlet means disposed within the impeller casing for the introduction of water into the impeller chamber, impeller means disposed to move eccentrically within the impeller chamber to a location in close proximity to the impeller casing, the water inlet means being positioned within the impeller casing at the location for facilitating the conveyance through said centrifugal pump whereby the pump is free from abrasion caused by solid maters in the fluid.

3 Claims, 6 Drawing Figures

SUPERCAVITATION CENTRIFUGAL PUMP

This application is a continuation of application Ser. No. 671,303 filed on Nov. 14, 1984, now abandoned.

BACKGROUND OF THE INVENTION

The present invention relates to a high performance supercavitation centrifugal pump capable of lifting or driving liquids and slurries with or without lumpy solid matters such as ore, soil, sand, gravel, straw, fishes, foodstuffs, flocks, etc. contained in the lifting or driving fluid without damage from such solid matters. The pump generates a high suction pressure and has a powerful gas and vapor expulsion abilities, and is not only free from the cavitation erosion, but also free from the abrasion, damage or destruction caused by solid matters or gases in the lifting or driving fluid.

In the conventional centrifugal pumps, the impeller blades or vanes suffer from severe frictional abrasions by solid matters contained in the liquid, and the discharge port of the pump is frequently clogged by solid matters since the solid matters tangle or cling to the impeller blades or vanes. Furthermore, the impeller blades or vanes are subjected to the severe erosion and vibrations caused by the fixed cavitations even in the aerated liquid containing above 10% of gas, resulting in the sharp decrease of the suction power and finally in the destruction of the impeller.

In the construction of the conventional centrifugal pumps, the volute casing of the pump is provided with a nose portion or whirl point protruded from the inside surface near the discharge port of the casing toward the impeller in order to prevent the lifting fluid from being recycled together with and around the impeller, but said casing has the drawbacks that the solid matters are clung to said nose portion and thus crushed or destroyed, and the pumping efficiency is decreased due to the whirlpool caused by the increasing relative velocity of the liquid and the impeller, and the pump casing and the impeller themselves are damaged due to the collision and friction by the solid matters in the lifting fluid, resulting in the damage and destruction of the solid matters in the liquid. Besides, the conventional centrifugal pumps sometimes require the auxiliary pumps for self-suction in the initial operation stage.

It is therefore an object of the present invention to eliminate such drawbacks so as to provide an improved centrifugal pump, more particularly a powerful supercavitation centrifugal pump for handling agricultural and marine products, for hydraulic conveying systems in the fields of construction works, heavy industries, mining, environmental sanitation, and chemical processess such as agitation, aeration, washing, separation, classification, thickening, mixing, scum breaking, hydraulic dredging, hydraulic excavation, ore dressing, sand trapping, coal dressing, peat handling, fish breeding, sewage treatment, food processing, slug and coke powder treatment, mill scale treatment, dredging of deposited sludge and sand, flock ejecting and conveying, pulp sludge conveying, cattle nightsoil treatment, and emergency draining, etc.

BRIEF DESCRIPTION OF THE DRAWINGS

In order to accomplish such object, the pump is provided with a supercavitation mechanism in accordance with the present invention. The construction and operation of the preferred embodiments of the present invention will be more particularly described with reference to the accompanying drawings, wherein.

DETAILED DESCRIPTION OF THE INVENTION

Figure 1:
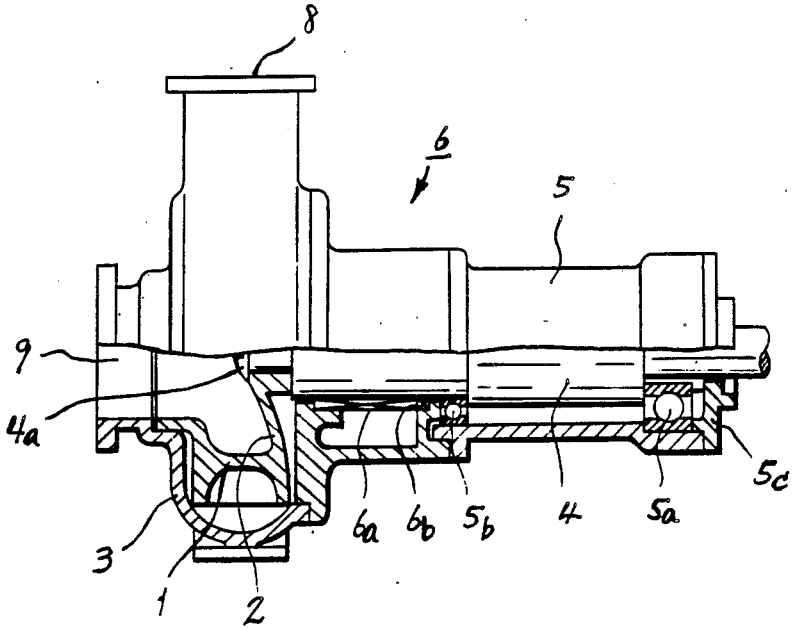
FIG. 1 is a partly sectional, front view of the supercavitation centrifugal pump of the present invention.

Referring to FIG. 1, the supercavitation centrifugal pump of the present invnetion comprises:

an impeller 2 having at least one supercavitation blade 1, an impeller casing 3 having a discharge port 8 and a suction port 9, a water inlet 7 within the impeller casing 3 for introduction of water in a impeller chamber (FIG. 2), a shaft assembly containing a main shaft 4, a main bearing 5*a*, a free bearing 5*b*, a bearing housing 5, and a bearing side cover 5*c*, and a seal assembly containing an oil retainer 6*b*, a seal 6*a*, and a seal housing 6, wherein the impeller 2 is securely mounted on one end of the main shaft 4 by means of a locking bolt 4*a* and positioned within the semi-circular portion of the impeller casing 3, and the shaft assembly is assembled in the manner well known to those skilled in the art.

Figure 2:
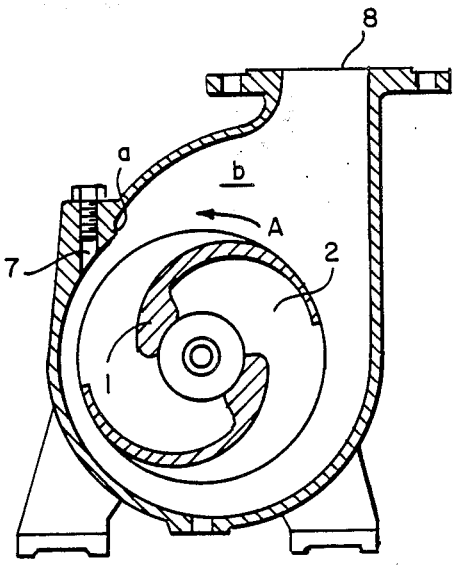
FIG. 2 is a cross-sectional view of FIG. 1 of the present invention.

As shown in FIG. 2, there is formed no particular nose portion or whirl point in the vicinity of the discharge port 8 of the impeller casing 3. However, an inside portion a of the water filling inlet 7 is disposed around the discharging port, as a nose portion or whirl point which the case is in the conventional centrifugal pumps.

The main shaft 4 is positioned a little eccentrically to the inside portion a in the vicinity of the water filling inlet 7, and the space between the impeller 2 and the casing 3 becomes gradually greater in the rotational direction indicated by arrow A to form a large space b near the feed inlet 8. Accordingly, solid matters can be not only easily discharged without being clung to the inside portion a and without damage of the impeller 2 and casing 3, but also the loss of the pump efficiency can be minimized since the relative velocity of the liquid and the impeller can be maintained at the minimum.

Figure 3:
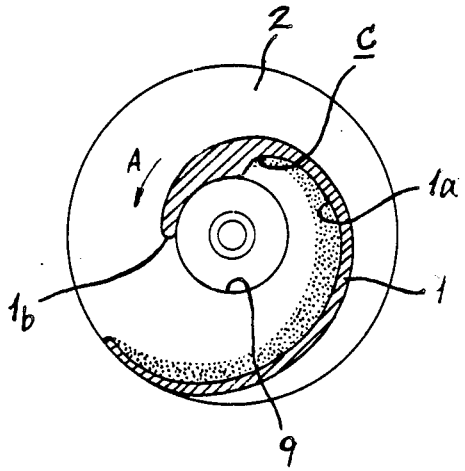
FIG. 3 is a cross-sectional view illustrating an embodiment of the impeller of the present invention.

FIGS. 3 to 6 illustrate the preferred embodiments of the impeller in accordance with the present invention. FIG. 3 shows a standard supercavitation impeller 2 having a single blade 1. The curved outer surface of the blade 1 is formed like a volute shape or spiral-like, beginning from a point on the periphery of the suction port 9 and winding around the suction port 9 in about 360°. A front edge 1*b* of the blade 1 rotates in the direction indicated by arrow (A) so as to facilitate the smooth passing of solid matters. A inner surface 1*a* of the blade 1 rotates so as to form a supercavitation along the entire inner surface 1*a* of the blade 1. A forward end portion of the blade 1 is wound in about 90° along the periphery of said suction port 9, and then, a deep recess c is radially formed on said inner surface 1*a* from the point of 90° from said front edge 1*b*, whereby a incipient or initial cavitation is formed in the area of the recess, c, and the initial cavitation grows along the entire inner surface 1*a* of the blade 1 to form a stable supercavitation, thereby the whole inner surface 1*a* of the blade 1 envelopes with a smooth sheet of the cavitation and thus stabilizes the liquid flow. Accordingly, the impeller blade 1 of the present invention is a supercavitating blade of non-clog type which is not adversely affected by the fixed cavitation.

Figure 4:
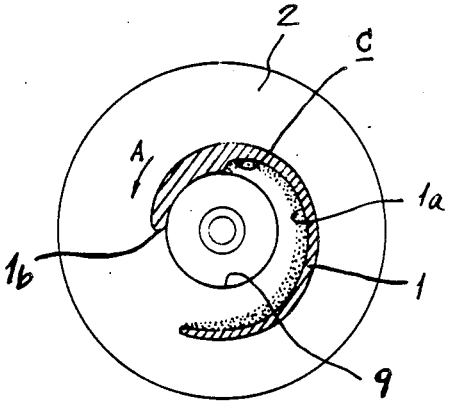
FIG. 4 is a cross-sectional view illustrating another embodiment of the impeller of the present invention.

FIG. 4 illustrates another embodiment of the present invention which shows a supercavitation impeller of non-damage type having a single but shorter blade 1 for lifting or driving relatively larger solid matters such as fishes, gravels, and flocks outer surface of the blade 1 is shaped to conform to the volute curve, and the rear end portion of the blade 1 forms a part of the concentric circumference with respect to the impeller 2 so as to allow the smooth passing of bigger solid matters.

Figure 5:
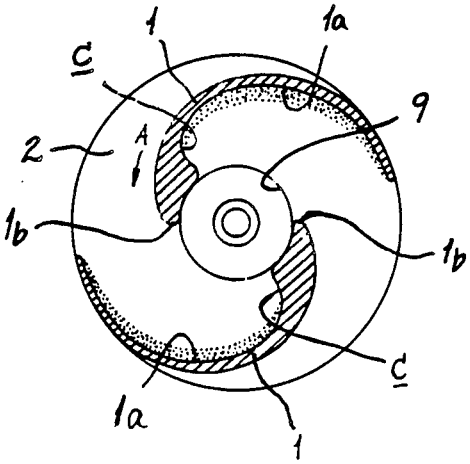
FIG. 5 is a cross-sectional view illustrating a further embodiment of the impeller of the present invention.

FIG. 5 shows a further embodiment of the present invention which is a supercavitation impeller 2 having two blades. The curved outer surface of each blade 1 forms a volute curce wound spiral-like, beginning from the respective opposite points on the periphery of the suction port 9 and each winding spirally around the suction port 9 in about 180°, and the front edges 1*b*, of the blades 1 is rounded so as to facilitate the smooth passing of solid matters. As shown in FIG. 5, after the forward end portion of the inner surface 1*a* of the blade 1 is wound in about 45° along the periphery of the suction port 9, the recess c is then radially formed on the inner surface 1*a* of the blade 1 from the point of 45° from the front edge 1*b* whereby the incipient or initial cavitation is formed in the area of recess c, and the initial cavitation grows along the inner surface 1*a* of each blade 1 to form a long and stable supercavitation and thereby to stabilize the liquid flow.

Figure 6:
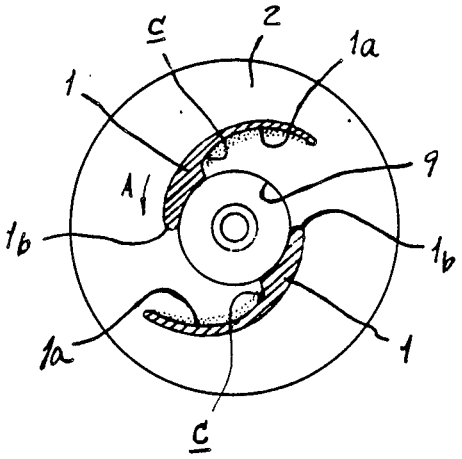
FIG. 6 is a cross-sectional view illustrating a still further embodiment of the impeller of the present invention.

FIG. 6 illustrates a still another embodiment of the present invention. This embodiment provides also a high lift supercavitation impeller 2 of non-damage type. The impeller 2 has two or more blades 1, which are made shorter so as to generate a high suction power by forming a supercavitation at high speed and to allow a smooth passing of even bigger solid matters.

As described above, on the contrary to the conventional impeller blade, the supercavitation impeller blade 1 of the present invention is characterized in that the blade 1 is provided with the deep recess C disposed at the inner surface adjacent to the suction port 9 whereby the recess c produces an initial cavitation which in turn forms supercavitation so that the liquid flow is stabilized without causing erosions and vibrations. Accordingly, the present invention is to provide a supercavitation centrifugal pump with a small cavitation number. A high vacuum is generated along the inner surface 1*a* of the blade 1, and the frictional resistance is minimized due to the one-sided friction only between the lifting fluid and the outer surface of the blade 1.

Referring to FIG. 2, when viewing clockwise from the back side of the drawing the flow speed is fastest in 9 o'clock direction (i.e. in the vicinity of the discharge port 8), and the flow speed varies frequently in the direction between 10 and 12 o'clock, and the flow speed is lowest in the direction between 12 and 1 o'clock since the inside portion a is positioned at 1 o'clock direction whereby the longer and bigger solid matters discharged from the impeller 2 toward the discharge port 8 are prevented from being clung to the impeller so that the impeller and the casing 3 are protected from damage or destruction. Furthermore, the gas and vapor expulsion ability is improved facilitate the gas-liquid separation and thus the liquid circulation.

According to the present invention, the supercavitation centrifugal pump can be operated also under the suction pressure of above 755 mm Hg (5 Torr) without being clogged or tangled for driving or lifting highly concentrated and viscous liquids such as fermenting sludge, volatile and aerated liquids as well as solid containing liquids such as ore, gravel, sand, mill scale, and mud.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

I claim:

1. A supercavitation centrifugal pump comprising:

an impeller casing defining an impeller chamber, a discharge port and a suction port operatively connected to said impeller casing, a water inlet means disposed within said impeller casing for the introduction of water into the impeller chamber, and impeller means disposed to move eccentrically within the impeller chamber to a location in close proximity to the impeller casing, said impeller means being provided with at least one blade which contains a deep recess which extends substantially radially from the blade shaft towards the periphery of the blade and further extends substantially perpendicular to said radial extension whereby the pump is free from abrasion caused by solid matters in the fluid, said water inlet means being positioned within said impeller casing at a location in the vicinity of the narrow space between the impeller casing and the end portions of the blades for facilitating the conveyance through said centrifugal pump.

2. The supercavitation centrifugal pump of claim 1 wherein the small radius of curvature is sufficient severe as to be substantially located along a rounded line extending from the axis of the impeller.

3. The supercavitation centrifugal pump of claim 2 wherein the impeller contains two blades and the deep recess in said blades oppose each other along said radial line.

* * * * *